United States Patent [19]

Sironi

[11] 4,255,874

[45] Mar. 17, 1981

[54] LUG SOLE FOR FOOTWEAR

[75] Inventor: Giuseppe Sironi, Cerro di Laverno Mombello, Italy

[73] Assignee: Vibram S.p.A., Albizzate, Italy

[21] Appl. No.: 58,720

[22] Filed: Jul. 18, 1979

[51] Int. Cl.[3] ..... A43B 13/04; A43B 13/26; A43C 15/00

[52] U.S. Cl. ..... 36/32 R; 36/59 C; D2/320

[58] Field of Search ..... 36/32 R, 59 R, 59 A, 36/59 B, 59 C; D2/320, 321

[56] References Cited

U.S. PATENT DOCUMENTS 4,060,917 12/1977 Canale ..... 36/32 R

FOREIGN PATENT DOCUMENTS 1110968 10/1955 France ..... 36/59 R 214887 8/1941 Switzerland ..... 36/59 C 473286 10/1937 United Kingdom ..... 36/59 C 962676 7/1964 United Kingdom ..... 36/59 C 973691 10/1964 United Kingdom ..... 36/59 C

OTHER PUBLICATIONS

*Austrian Export,* Perfekta, p. 28.

Production/New Products, Apr. 1, 1965, p. 89.

*Primary Examiner*—James Kee Chi

*Attorney, Agent, or Firm*—Thompson, Birch, Gauthier & Samuels

[57] ABSTRACT

A lug sole for footwear. The sole has integral downwardly extending legs located around the sole periphery. Some of the lugs are formed of the identical hard rubber composition as the body of the sole. The other lugs are formed of a softer rubber composition. The hard lugs and the soft lugs are disposed in a generally alternating arrangement.

8 Claims, 3 Drawing Figures

LUG SOLE FOR FOOTWEAR

BACKGROUND OF THE INVENTION

This invention related to an improved molded rubber lug sole for footwear. Presently, conventional rubber lug soles have a bottom surface from which integral lugs extend downwardly. The lugs all have the same composition and hardness and are disposed about the periphery of both the sole and the heel portions. The lugs are shaped and spaced-apart from each other such that the soles will adhere to or "grip" the underlying ground surface in the same manner as rubber tires "grip" the road.

Lug soles are made in two basic styles. Conventional soles have a sole portion and a connected thin heel-attaching portion. Separate conventional heels are used with such conventional soles. A relatively recent innovation is the unit sole which combines the sole and the heel in one integral "unit sole". The present invention can be utilized by both styles.

At present, lug soles are tuypically molded from a single slug of synthetic rubber which is sufficiently hard so that the lugs will adequately support the weight of the wearer even in extreme conditions. Unfortunately, when the lugs have this hardness, typically about 85 Shore A hardness, the lugs tend to slip on hard underlying surfaces, such as rock. Obviously, such a slipping tendency creates a danger to a wearer who is hiking on a rocky trail or who is climbing up a rocky incline.

On the other hand, some present lug soles are made of softer synthetic rubber. However, softer lugs do not provide adequate support to a wearer in crucial situations where high stresses occur. Thus, a sole with soft lugs would be inadequate for the serious hiker or climber.

Accordingly, it is the object of this invention to provide a lug sole which has sufficient hardness to adequately support the wearer's weight even in extreme situations, and which has sufficient softness to provide good adhesion even on rocky surfaces.

SUMMARY OF THE INVENTION

The lug sole of this invention has a plurality of downwardly extending spaced-apart lugs which are integral with the sle and which are located around the periphery of the sole. The lugs are two different hardnesses. The hard lugs have the identical hardness as the sole body. The soft lugs are less hard (i.e. softer) than the hard lugs. The hard lugs are disposed in an alternating arrangement with the soft lugs around most of the periphery of the sole. The star-shaped lug-like portions in the central portion of the sole may be either hard or soft.

DETAILED DESCRIPTION OF THE PREFERRED EMBODIMENT

Figure 1:
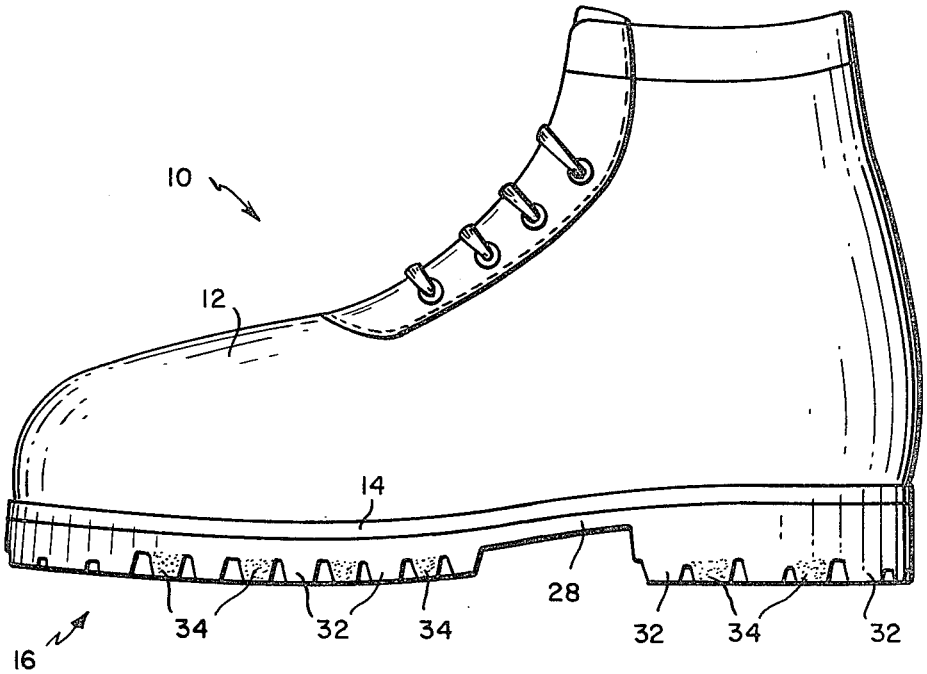
FIG. 1 is a side elevation of about which has the lug sole of this invention.

FIG. 1 shows a conventional boot 10 having a leather upper 12, a mid-sole 14, and a rubber lug sole 16. The leather upper 12 and the mid-sole 14 are conventional and need not be further described.

The lug sole is preferably made of synthetic rubber although it could possibly be made of natural rubber. It could also be made of other materials such as various plastics. Lug sole 16 is shown in solid as a unit sole in FIG. 3, and alternatively is shown in dotted as a conventional sole with a heel-attaching portion 18 and a separate conventional heel 20 in FIG. 3.

Figure 2:
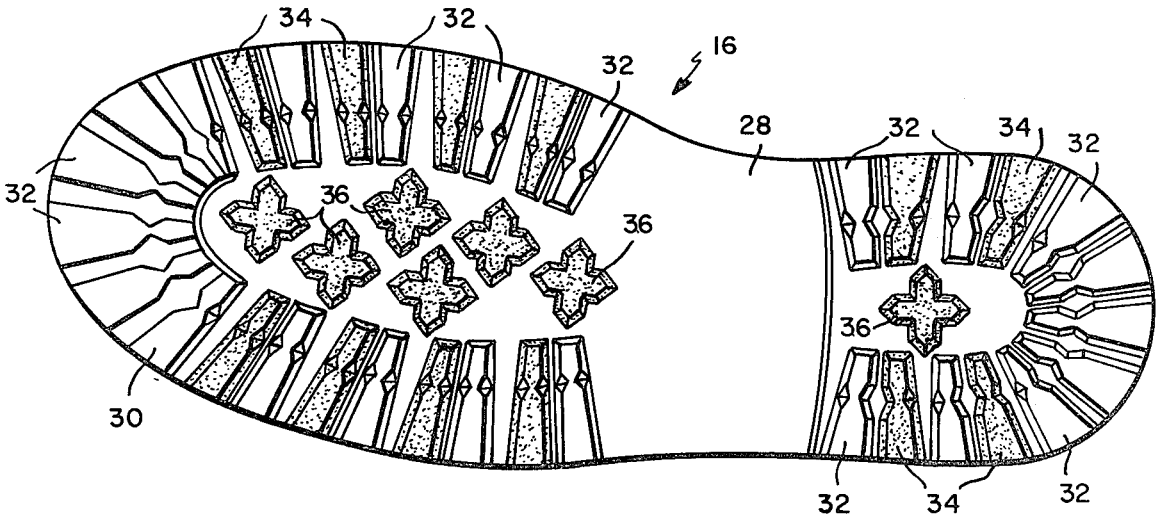
FIG. 2 is a bottom plan view of the lug sole shown in FIG. 1.
Figure 3:
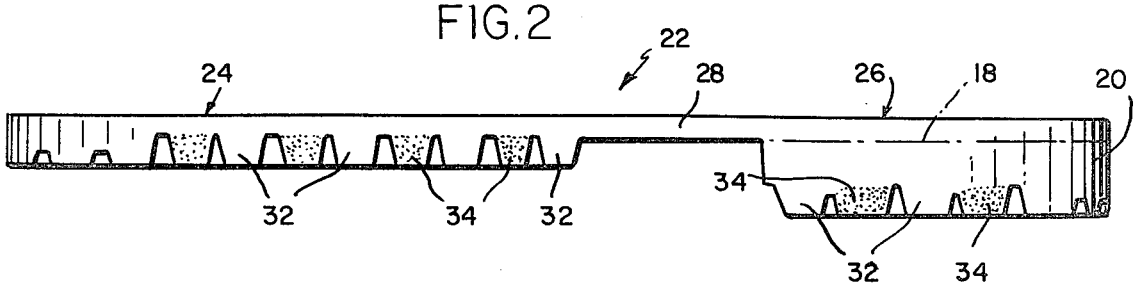
FIG. 3 is a side elevation of the lug sole shown in FIG. 2.

FIGS. 2 and 3 show the bottom and side views of the conventional lug arrangement of a typical lug sole as made by Vibram S.p.A. of Italy and Quabaug Rubber Company of North Brookfield, Massachusetts. The differences between such conventional lug soles and the lug sole of this invention will now be described.

In its unit sole form, lug sole 16 has a sole body 22 which extends from the tip of the toe to the rear of the heel. The sole body 22 has a sole portion 24, a heel portion 26, and a shank portion 28 which connects the sole portion and the heel portion.

The top surface 30 of sole body 22 is adapted to be affixed to the bottom surface of mid-sole 14. A plurality of lugs extends downwardly from the bottom surface of sole body 22. All of the lugs have approximately the same shape and are spaced apart so as to minimize the retention of mud and pebbles between adjacent lugs.

Lugs 32 are relatively hard (about 85 Shore A hardness) and have the same hardness as sole body 22. Lugs 34 are relatively soft (about 65 Shore A hardness) and are less hard than sole body 22 or hard lugs 32. Hard lugs 32 alternate with the soft lugs 34 around most of the periphery of the sole and heel portions. The lugs at the tip of the toe and at the rear of the heel may be shallower and may all be hard because, when the wearer is mountain climbing, these areas undergo great stresses and flexing is undesirable. Lugs 32 and 34 both have similar wear resistance.

In describing lugs 32 and 34, the terms "hard" and "soft" have been used. Preferably, these terms indicate about 85 and 65 Shore A hardnesses, respectively. However, variations of these hardness ratings would still produce useful embodiments. The important feature is the use of lugs of differing hardnesses. For example, Shore A ratings of 90 and 60, or 80 and 70, for lugs 32 and 34, respectively, would also be useful.

Likewise, in describing the lug arrangement as "alternating", it is meant that the hard and soft lugs are substantially interspersed, not that they are necessarily sequentially alternated. The important feature is the general overall dispersion of both hard and soft lugs over the sole and heel portions.

In addition to the arrangement of elongated lugs aroud the periphery of the sole body 22, the preferred embodiment also has a plurality of star-shaped portions 36. These stars (which usually have from three to eight "points" or radially extending arms) are located in the center of the sole portion 24 and in the center of the heel portion 26. Preferably, the stars are relatively soft like soft lugs 34, although they could be hard like hard lugs 32.

The manufacturing process by which the soles of this invention are made will now described. Conventionally, lug soles are made by a one step hot molding process. A single slug of synthetic rubber is placed in a two part mold wherein the slug is subjected to heat and pressure. As a result, the slug assumes the shape of the interior of the mold. This molding process creates a conventional lug sole in which all of the lugs have the same hardness.

The lug sole of the present invention is made in a different manner. First, small rubber slug pieces having a lesser Shore A hardness (about 65) are dropped into each mold cavity portion that is intended to form a soft lug 34 or a soft star 36. Then, a single large rubber slug having a greater Shore A hardness (about 85) is dropped into the mold to form the hard lugs 32 and the sole body 22. The soft and hard slugs are vulcanized in the mold into an integral unit as shown in FIGS. 2 and 3.

The rubber sole of this invention has hard and soft lugs. The soft lugs achieve an effective grip on hard rocky surfaces. The hard lugs support the wearer's weight and limit the deflection of the soft lugs. The hard lugs and the soft lugs cooperate to produce a sole that is more effective than either an all hard lug sole or an all soft lug sole. Furthermore, because the hard and soft lugs cooperate and assist each other in previously unknown ways, their interrelationship produces an unexpectedly improved and advantageous result.

It is understood that this invention includes all modifications which would be obvious to those skilled in the art. The invention is limited only by the appended claims.

I claim:

1. A sole comprising: a relatively hard sole body having a top surface adapted to be affixed to a mid-sole, said sole body also having a bottom surface, a plurality of downwardly extending, spaced apart first lugs integral with and located around a considerable portion of the periphery of said sole body bottom surface, said first lugs having the same hardness as said sole body, and a plurality of downwardly extending, a spaced-apart second lugs integral with and located around a considerable portion of the periphery of said sole body bottom surface, said second lugs disposed in a substantially alternating arrangement with said first lugs, said first and second lugs having the same height as measured from said bottom surface, with said second lugs being relatively soft in comparison to said first lugs.

2. The sole of claim 1 wherein all said lugs are made of synthetic rubber.

3. The sole of claim 1 wherein said sole body is a one piece unit sole having a sole portion and a heel portion.

4. The sole of claim 1 wherein said sole body is a conventional sole having a sole portion and a thin heel-attaching portion.

5. The sole of claim 1 wherein a plurality of downwardly extending spaced-apart star-shaped portions is located in the approximate center of said sole body bottom surface.

6. The sole of claim 5 wherein said star-shaped portions have the same relative softness as said second lugs.

7. The sole of claim 1 wherein said first lugs are synthetic rubber and have a Shore A hardness of between about 80 and about 90.

8. The sole of claim 7 wherein said second lugs are synthetic rubber and have a Shore A hardness of between about 60 and 70.

* * * * *